US006165972A

United States Patent [19]

Weinelt et al.

[11] Patent Number: 6,165,972

[45] Date of Patent: Dec. 26, 2000

[54] SOLID SURFACTANT MIXTURES COMPRISING FATTY ACID POLYHYDROXYAMIDES

[75] Inventors: Frank Weinelt; Helmut Keck, both of Burgkirchen, Germany

[73] Assignee: Clariant GmbH, Frankfurt, Germany

[21] Appl. No.: 09/387,401

[22] Filed: Sep. 2, 1999

[30] Foreign Application Priority Data

Sep. 4, 1998 [DE] Germany ..... 198 40 342

[51] Int. Cl.[7] ..... C11D 13/10; C11D 3/32

[52] U.S. Cl. ..... 510/502; 510/276; 510/289; 510/290; 510/340; 510/351; 510/352; 510/356; 510/357; 510/358; 510/413; 510/414; 510/421; 510/426; 510/428; 510/452; 510/456

[58] Field of Search ..... 510/276, 289, 510/290, 340, 351, 352, 356, 357, 358, 413, 414, 421, 426, 428, 452, 456, 502

[56] References Cited

U.S. PATENT DOCUMENTS

| | | | |
|---|---|---|---|
| 5,378,388 | 1/1995 | Pancheri | 252/174.25 |
| 5,466,802 | 11/1995 | Panandiker et al. | 544/193.2 |
| 5,500,154 | 3/1996 | Bacon et al. | 252/551 |
| 5,783,546 | 7/1998 | Bettiol et al. | 510/305 |
| 5,804,543 | 9/1998 | Wertz et al. | 510/303 |

FOREIGN PATENT DOCUMENTS

| | | |
|---|---|---|
| 4326950 | 2/1995 | Germany . |
| 4424823 | 1/1996 | Germany . |
| 4430085 | 2/1996 | Germany . |
| 4432366 | 3/1996 | Germany . |
| WO 92/06153 | 4/1992 | WIPO . |
| WO 92/06156 | 4/1992 | WIPO . |
| WO 92/06157 | 4/1992 | WIPO . |
| WO 92/06158 | 4/1992 | WIPO . |
| WO 92/06159 | 4/1992 | WIPO . |
| WO 92/06160 | 4/1992 | WIPO . |

OTHER PUBLICATIONS

Derwent Patent Family Report and/or Abstracts.

*Primary Examiner*—Yogendra Gupta
*Assistant Examiner*—Charles Boyer
*Attorney, Agent, or Firm*—Miles B. Dearth; Scott E. Hanf

[57] ABSTRACT

A solid surfactant mixture, comprising one or more fatty acid polyhydroxyamides of the formula I $$RCONR^1Z \quad (1)$$

in which R is $C_7$–$C_{31}$-alkyl or $C_7$–$C_{31}$-alkenyl, Z is a polyhydroxyhydrocarbon group having at least two hydroxyl groups, which may also be alkoxylated, and $R^1$ is $C_1$–$C_8$-alkyl or a group of the formula —$(CH_2)_xNR^2R^3$ or $R^4O(CH_2)_n$—, $R^2$ and $R^3$ are $C_1$–$C_4$-alkyl or $C_2$–$C_4$-hydroxyalkyl, $R^4$ is $C_1$–$C_4$-alkyl and x is a number from 1 to 10 and n is a number from 2 to 4, one or more other nonionic surfactants and/or one or more anionic surfactants.

9 Claims, No Drawings

SOLID SURFACTANT MIXTURES COMPRISING FATTY ACID POLYHYDROXYAMIDES

BACKGROUND OF THE INVENTION

The use of fatty acid N-alkyl-polyhydroxyalkylamide, in particular of fatty acid N-methylglucamide, in detergents and cleaners is known from DE-A-4 430 085, DE-A-4 326 950, DE-A-4 432 366, DE-A-4 424 823, WO 92/06153, WO 92/06156, WO 92/06157, WO 92/06158, WO 92/06159 and WO 920/6160.

Essential advantages of the fatty acid N-alkyl-polyhydroxyalkylamides are their high cleaning power, their good biodegradability and the fact that they are prepared from renewable raw materials.

A disadvantage for the use and formulatability is a limited solubility in water of this class of surfactants, in particular from a chain length of C16 or more. At higher concentrations in water, fatty acid-N-alkyl-polyhydroxyalkylamides tend to form gels, or they form precipitates. Higher temperatures to reduce gel formation and viscosity lead to increased hydrolysis of the detersive substance.

WO 92/06160 describes preparations in the form of a paste which comprise fatty acid N-alkyl-polyhydroxyalkylamide and ethoxylated nonionic surfactants, in particular ethoxylated alkylphenols, ethoxylated primary and secondary aliphatic alcohols or ethoxylated alkylpolysaccharides.

SUMMARY OF THE INVENTION

It is an object of the present invention to develop surfactant mixtures which are based on fatty acid N-alkyl-polyhydroxyalkylamides, which are solid and which dissolve quickly and at low temperatures in water.

Surprisingly, it has been found that the solubility of fatty acid N-alkyl-polyhydroxyalkylamide in water can be effected or improved significantly by addition of nonionic surfactants, in particular by fatty acid amidoethoxylates, but also by fatty alcohol ethoxylates, or by combination of a mixture of nonionic surfactants with anionic surfactants. The combination of nonionic surfactant, in particular fatty acid amidoethoxylate, and an anionic surfactant, in particular linear alkylbenzenesulfonate and/or fatty alcohol sulfate, has a synergistic effect on the solubility of fatty acid polyhydroxyamide in water.

The invention provides solid surfactant mixtures, comprising one or more fatty acid N-alkylpolyhydroxylalkylamides (fatty acid polyhydroxyamides) of the formula I $$RCONR^1Z \qquad (1)$$

in which R is $C_7$–$C_{31}$-alkyl or $C_7$–$C_{31}$-alkenyl, Z is a polyhydroxyhydrocarbon group having at least two hydroxyl groups, which may also be alkoxylated, and $R^1$ is $C_{1-C8}$-alkyl or a group of the formula —$(CH_2)_xNR^2R^3$ or $R^4O(CH_2)_n$—, $R^2$ and $R^3$ are $C_1$–$C_4$-alkyl or $C_2$–$C_4$-hydroxyalkyl, $R^4$ is $C_1$–$C_4$-alkyl, n is a number from 2 to 4 and x is a number from 1 to 10, and one or more other nonionic surfactants and/or one or more other anionic surfactants.

DESCRIPTION OF THE PREFERRED EMBODIMENTS

Preferred compounds of the formula 1 are those in which R is $C_7$–$C_{21}$-alkyl or $C_8$–$C_{21}$-alkenyl. Thus, the radical RCO— can, for example, be the alkyl radical of coconut fatty acid, stearic acid, oleic acid, lauric acid, myristic acid, capric acid, palmitic acid or tallow fatty acid. $R^1$ is preferably $C_1$–$C_4$-alkyl and Z is preferably a group of the formula —$CH_2(CHOH)_4CH_2OH$, for example 1-deoxyglucityl, 2-deoxyfructityl, 1-deoxymaltityl, 1-deoxylactityl, 1-deoxygalactityl, 1-deoxymannityl, 1-deoxymaltotriotityl. Particular preference is given to $C_8$–$C_{22}$—, in particular $C_{12}$–$C_{18}$-acyl-N-methylglucamides.

The compounds of the formula 1 are prepared in a manner known per se by reductive amination of a reductive sugar with an alkylamine and subsequent esterification with a fatty acid or fatty acid ester. More details about the preparation of these compounds can be found in WO 92/06160 and in the literature cited therein.

In addition to the fatty acid polyhydroxyamides of the formula 1, the surfactant mixtures according to the invention also comprise other nonionic and/or anionic surfactants.

Preferred other nonionic surfactants are fatty acid amides, in particular those of the formula $$R—CON(R^1)_2$$

in which R is an alkyl group or alkenyl group having 7 to 21, preferably 9 to 17 carbon atoms and each radical $R^1$ is hydrogen, $C_1$–$C_4$-alkyl, $C_1$–$C_4$-hydroxyalkyl and —$(C_2H_4O)_xH$, where x varies from 1 to 15. Preference is given to fatty acid amides of the abovementioned formula where R is $C_8$–$C_{18}$-alkyl or $C_8$–$C_{18}$-alkenyl, one radical $R^1$ is hydrogen and the other radical $R^1$ is a group of the formula —$(C_2H_4O)_xH$ where x is from 2 to 10.

Further preferred nonionic surfactants are fatty alcohol ethoxylates having from about 1 to about 25 mol of ethylene oxide. The alkyl chain of the aliphatic alcohols can be linear or branched, primary or secondary, and generally contains from 8 to 22 carbon atoms. Particular preference is given to the condensates of alcohols which contain an alkyl chain of from 10 to 20 carbons with from 2 to 18 mol of ethylene oxide per mol of alcohol. The alkyl chain can be saturated or else unsaturated. Likewise, the alcohol ethoxylates can have a narrow homolog distribution of the ethylene oxide ("narrow range ethoxylates") or a broad homolog distribution of the ethylene oxide ("broad range ethoxylates"). Examples of commercially available nonionic surfactants of this type are Tergitol™ 15-S-9 (condensate of a C11–C15 linear secondary alcohol with 9 mol of ethylene oxide), Tergitol™ 24-L-NMW (condensate of a C12–C14-linear primary alcohol with 6 mol of ethylene oxide having a narrow molecular weight distribution). This class of product also includes the Genapol™ products from Clariant GmbH.

Suitable according to the invention are furthermore also other known types of nonionic surfactants, such as polyethylene oxide, polypropylene oxide and polybutylene oxide adducts of alkylphenols having from 6 to 12 carbon atoms in the alkyl chain, addition products of ethylene oxide with a hydrophobic base, formed by condensation of propylene oxide with propylene glycol, or addition products of ethylene oxide with a reaction product of propylene oxide and ethylenediamine.

Instead of or in addition to the nonionic surfactants, the mixtures according to the invention may also comprise anionic surfactants, in addition to the fatty acid polyhydroxyamides.

Especially suitable anionic surfactants are alkyl sulfates, alkyl sulfonates, alkylcarboxylates, alkyl phosphates and mixtures of said compounds. Some of the suitable types of anionic surfactants are described in more detail below.

Alkyl Ether Sulfonates

Alkyl ether sulfonates are linear esters of $C_8$–$C_{20}$-carboxylic acids (i.e. fatty acids) which are sulfonated by $SO_3$, as described in "The Journal of the American Oil Chemists Society", 52 (1975), pp. 323–329. Suitable starting materials are natural fatty derivatives, such as, for example, tallow or palm oil fatty acid.

Alkyl Sulfates

Alkyl sulfates are water-soluble salts or acids of the formula $ROSO_3M$, in which R is preferably a $C_{10}$–$C_{24}$-hydrocarbon radical, preferably an alkyl or hydroxyalkyl radical having 10 to 20 carbon atoms, particularly preferably a $C_{12}$–$C_{18}$-alkyl or -hydroxyalkyl radical. M is hydrogen or a cation, for example an alkali metal cation (for example sodium, potassium, lithium) or ammonium or substituted ammonium, for example a methyl-, dimethyl- and trimethylammonium cation or a quaternary ammonium cation, such as tetramethylammonium and dimethylpiperidinium cation, and quaternary ammonium cations derived from alkylamines such as ethylamine, diethylamine, triethylamine and mixtures thereof. Alkyl chains having $C_{12}$–$C_{16}$ are preferred for low washing temperatures (for example below about 50° C.) and alkyl chains having $C_{16}$–$C_{18}$ are preferred for higher washing temperatures (for example above about 50° C).

Alkyl Ether Sulfates

Alkyl ether sulfates are water-soluble salts or acids of the formula $RO(A)_mSO_3M$, where R is an unsubstituted $C_{10}$–$C_{24}$-alkyl or hydroxyalkyl radical having from 10 to 24 carbon atoms, preferably a $C_{12}$–$C_{20}$-alkyl or hydroxyalkyl radical, particularly preferably a $C_{12}$–$C_{18}$-alkyl or hydroxyalkyl radical. A is an ethoxy or propoxy unit, m is a number greater than 0, typically between about 0.5 and about 6, particularly preferably between about 0.5 and about 3 and M is a hydrogen atom or a cation, such as, for example, a metal cation (for example sodium, potassium, lithium, calcium, magnesium, etc.), ammonium or a substituted ammonium cation. Examples of substituted ammonium cations are methyl-, dimethyl-, trimethylammonium and quaternary ammonium cations, such as tetramethylammonium and dimethylpiperidinium cations, and also those derived from alkylamines, such as ethylamine, diethylamine, triethylamine, mixtures thereof and the like. Examples which may be mentioned are $C_{12}$–$C_{18}$-alkylpolyethoxylate (1.0)sulfate, $C_{12}$–$C_{18}$-alkylpolyethoxylate (2.25)sulfate, $C_{12}$–$C_{18}$-alkylpolyethoxylate (3.0)sulfate, $C_{12}$–$C_{18}$-alkylpolyethoxylate (4.0)sulfate, where the cation is sodium or potassium.

Alkylbenzenesulfonates

Another suitable anionic surfactant which can be used according to the invention is alkylbenzenesulfonate. The alkyl group can either be saturated or unsaturated, branched or linear and unsubstituted or substituted by a hydroxyl group. Preferred alkylbenzenesulfonates contain linear alkyl chains having from 9 to 25 carbon atoms, preferably from 10 to 13 carbon atoms, the cation being sodium, potassium, ammonium, mono-, di- or triethanolammonium, calcium or magnesium, and mixtures thereof. For mild surfactant systems, magnesium is the preferred cation, but for standard washing applications, sodium is preferred.

Secondary Alkanesulfonates

In secondary alkanesulfonates, the alkyl group can either be saturated or unsaturated, branched or linear and unsubstituted or substituted by a hydroxyl group. The sulfo group is randomly distributed over the whole carbon chain, the primary methyl groups at the start and end of the chain not carrying sulfonate groups. The preferred secondary alkanesulfonates contain linear alkyl chains having from 9 to 25 carbon atoms, preferably from 10 to 20 carbon atoms and particularly preferably from 13 to 17 carbon atoms. The cation is sodium, potassium, ammonium, mono-, di- or triethanolammonium, calcium or magnesium and mixtures thereof. Sodium is preferred as cation.

Soaps

Further preferred surfactants are carboxylates, for example fatty acid soaps and comparable surfactants. These soaps can be saturated or unsaturated and can contain various substituents, such as hydroxyl groups or alpha-sulfonate groups. Preference is given to linear saturated or unsaturated hydrocarbon radicals as the hydrophobic component in the soaps. The hydrophobic components usually contain from 6 to 30 carbon atoms, preferably from 10 to 18 carbon atoms. The cation (M) of the carboxylate surfactants can be an alkali metal, for example sodium or potassium, an alkaline earth metal, for example calcium or magnesium, ammonium or substituted ammonium, including mono-, di- and triethanolammonium. Mixtures of the cations can also be advantageous.

Other suitable anionic surfactants are $C_8$–$C_{24}$-olefinsulfonates, sulfonated polycarboxylic acids, alkyl glycerol sulfates, fatty acyl glycerol sulfates, oleyl glycerol sulfates, alkylphenol ether sulfates, primary paraffinsulfonates, alkyl phosphates, alkyl ether phosphates, isethionates, such as acylisethionates, N-acyltaurides, alkylsuccinamates, sulfosuccinates, monoesters of sulfosuccinates (particularly saturated and unsaturated $C_{12}$–$C_{18}$-monoesters) and diesters of sulfosuccinates (particularly saturated and unsaturated $C_{12}$–$C_{18}$-diesters), acylsarcosinates, sulfates of alkylpolysaccharides, such as sulfates of alkylpolyglycosides, branched primary alkyl sulfates and alkylpolyethoxycarboxylates of the formula $$RO(CH_2CH_2)_kCH_2COOM$$

in which R is $C_8$–$C_{22}$-alkyl, k is a number from 0 to 10 and M is a cation which forms soluble salt.

The ratio by weight of fatty acid polyhydroxyamides of the formula 1 to the other nonionic surfactants is generally from 90:10 to 10:90, preferably from 90:10 to 30:70, in particular from 80:20 to 50:50, and the ratio by weight of fatty acid polyhydroxyamides to anionic surfactants is approximately from 99:1 to 1:99, preferably from 90:10 to 10:90, in particular from 85:15 to 40:60. When using both nonionic and anionic surfactants, the mixing ratio of fatty acid polyhydroxyamide to the sum of nonionic and anionic surfactants can be approximately from 99:1 to 1:99. The ratio by weight of nonionic and anionic surfactants to one another is not crucial and can have any numerical values.

The combination of the fatty acid polyhydroxyamides in the surfactant mixtures according to the invention with other nonionic and/or with anionic surfactants results in an improved solubility of the fatty acid polyhydroxyamides in water, compared to when this surfactant group is used on its own.

The surfactant mixtures according to the invention are prepared in the following manner. Solid to highly viscous fatty acid polyhydroxyamide is heated to temperatures of from 40° C. to 130° C., preferably from 50° C. to 100° C., one or more other nonionic surfactants and/or one or more anionic surfactants are added, and the components are mixed intimately at these temperatures by kneading for a period of from 0.5 minutes to 180 minutes, preferably from 1 to 30 minutes. The resulting pasty mixtures solidify at room temperature to give solid to sticky-solid blocks, which can be processed further to granules in a further process step by addition of additives which are customary in the preparation of detergents and cleaners, such as, for example, builders, carrier materials, salts and extenders, surfactants, bleaches, optical brighteners, antiredeposition agents, bleach activators, solubilizers, disintegrants, antifoams and enzymes.

Customary builders are sheet silicates, for example SKS6, disilicates, sodium aluminum silicates (zeolites), phosphates, phosphonates, ethylenediaminetetraacetic acid, nitrilotriacetate, citric acid and/or polycarboxylates.

Suitable salts or extenders are, for example, sodium sulfate, sodium carbonate or sodium silicate.

Other additives can be sodium borate, starch, sucrose, polydextrose, stilbene compounds, toluenesulfonate, cumenesulfonate, soaps, silicones, lipases and proteases.

Suitable bleach activators are activated carboxylic esters, carboxylic anhydrides, lactones, acylates, carboxamides, acyllactams, acylated ureas and oxamides, but additionally in particular also nitriles and nitrilequats and mixtures thereof, for example tetraacetylethylenediamine (TAED), tetraacetylglucoluril (TAGU), diacetyldioxohexahydrotriazine (DADHT), acyloxybenzenesulfonates, such as nonanoyloxybenzenesulfonate-sodium (NOBS) or benzoyloxybenzenesulfonate (BOBS) and acylated sugars, such as pentaacetylglucose (PAG).

Suitable carrier materials are cellulose and cellulose derivatives, for example carboxymethylcellulose, methylcellulose, hydroxyethylcellulose, polyacrylates, copolymers of acrylic and maleic acid, tallow fatty ethoxylate, polyvinylpropylidene, polyethylene glycols, fatty acids, zeolites, bentonites, alkali metal sulfates, in particular $Na_2SO_4$, alkali metal carbonates, alkali bicarbonates, silicas, alkali metal silicates, alkali metal alumosilicates in amorphous or crystalline form and alkali metal citrates.

Other suitable additives are anionic and nonionic surfactants which have a favorable influence on the consistency and hardness of the granules, and on the homogeneous distribution of the components. Here, preferred anionic surfactants are alkali metal salts, ammonium salts, amine salts and salts of aminoalcohols of the following compounds: alkyl sulfates, alkyl ether sulfates, alkylamide sulfates and alkylamide ether sulfates, alkylaryl polyether sulfates, monoglyceride sulfates, alkylsulfonates, alkylamidesulfonates, alkylarylsulfonates, α-olefinsulfonates, alkylsulfosuccinates, alkyl ether sulfosuccinates, alkylamidesulfosuccinamates, alkyl sulfoacetates, alkyl polyglycerol carboxylates, alkyl phosphates, alkyl ether phosphates, alkyl sarcosinates, alkyl polypeptidates, alkylamido polypeptidates, alkyl ethionates, alkyl taurates, alkyl polyglycol ether carboxylic acids or fatty acids, such as oleic acid, ricinoleic acid, palmitic acid, stearic acid, copra oil acid salt or hydrogenated copra oil acid salts. The alkyl radical of all of these compounds usually contains 8–32, preferably 8–22, carbon atoms.

Preferred nonionic surfactants are polyethoxylated, polypropoxylated or polyglycerolated ethers of fatty alcohols, polyethoxylated, polypropoxylated and polyglycerolated fatty acid esters, polyethoxylated esters of fatty acids and of sorbitol and polyethoxylated or polyglycerolated fatty amides.

Also possible are additives which influence the bleaching capability, such as complex formers, polycarboxylates and iron- or manganese-containing metal complexes, as described in EP-A-0 458 397 and EP-A-0 458 398.

Other additives are substances which react in the washing liquid with peroxycarboxylic acid liberated from the activator, forming reactive intermediates, such as dioxiranes or oxaziridines, thus increasing the reactivity. The corresponding compounds are ketones and sulfonimines according to U.S. Pat. No. 3,822,114 and EP-A-0 446 982.

The mixtures according to the invention can be converted into granules by the following process steps:

a) Mixing of the compound comprising fatty acid polyhydroxyamide and other nonionic and/or anionic surfactants with one or more additives in a mixing unit (for example ploughshare mixer)

b) Comminuting these agglomerates to the desired particle size with the aid of mills, toothed-disk rollers and/or sieves c) Sieving off of fine fractions and coarse material.

While the coarse fraction is passed directly to be recomminuted, the fine fraction is fed to the compacting stage. The particle size of the product is generally in the range form 100–2000 μm. The bulk density of the granules according to the invention is above 500 kg/m$^3$, preferably above 600 kg/m$^3$.

The granules obtained in this way are suitable for direct use in detergents and cleaners. In a particularly preferred form of application, they can, however, be provided with a coating sheet.

To this end, the granule is coated with a film-forming substance in an additional step, as a result of which the product properties can be significantly influenced.

Suitable coating materials are all film-forming substances, such as waxes, silicones, fatty acids, soaps, anionic surfactants, nonionic surfactants, cationic surfactants, and also anionic and cationic polymers, for example polyacrylic acid.

Preference is given to using coating substances having a melting point of 30–100° C. Examples of these are described in EP-A-0 835 926.

By using these coating materials, it is possible to delay the dissolution behavior in order to stop interactions between the bleach activator and the enzyme system in this way at the start of the washing process. Moreover, suitable coating can reduce the content of dust and increase resistance to abrasion, and also further improve storage stability.

The coating materials are generally applied by spraying the molten coating materials or coating materials dissolved in a solvent.

The granules according to the invention are ideal for use in standard detergents, stain removal salts, dishwasher detergents, all-purpose cleaning powders and denture cleaners.

EXAMPLES

The examples below serve to illustrate the invention in more detail, without limiting it.

Example 1

500 g of C12/C14-fatty acid N-methylglucamide were introduced into 500 g of Genagen CA 050 which had been heated to 50° C., and the mixture was kneaded at this temperature for a period of 30 minutes. The resulting mixture can subsequently be processed to extrudates.

Example 2

A mixture of 630 g of C12/C14-fatty acid N-methylglucamide and 270 g of Genagen CA 030 was heated to 80° C. 100 g of Tensopol USP 94 were subsequently added, and the components were kneaded at 65° C. for 60 minutes to give a homogeneous mixture. This solid mixture was ground with 770 g of sodium carbonate to give a mixture in the form of granules.

Example 3

A mixture of 640 g of C12/C14-fatty acid N-methylglucamide and 160 g of Genagen CA 050 was heated to 45° C. and, with addition of 200 g of Hostapon SCID, kneaded for 10 minutes to give a homogeneous mixture. This mixture was then admixed with 42 g of a mixture of citric acid and $NaHCO_3$ in a molar ratio of 1:1, and kneading was continued for a further 15 minutes. The resulting mixture, which is solid at room temperature, was ground with 750 g of zeolite A and cooled to room temperature.

Example 4

700 g of a mixture of C16/C18-fatty acid N-methylglucamide and Genagen CA 050 in a ratio by weight of 70:30 was heated to 50° C., and 300 g of Tensopol USP 94 were added. The mixture was kneaded at 50° C for 15 minutes and cooled to room temperature. The mixture was subsequently ground with 1000 g of SKS 6 (sheet silicate).

To determine the solubility, the surfactant mixtures described above were ground to a particle size of 400 $\mu$g, and in each case 1 g was dissolved in water at 10° C. (data in % by weight based on the initial weight). In each case after 5 minutes, the fraction which had dissolved was determined. In this manner, the following solubilities were measured for the mixtures of Examples 1 to 4:

Example 1: 53%

Example 2: 47%

Example 3: 73%

Example 4: 65%

In addition, according to the procedure of Example 1, the solid mixtures listed in the table below were prepared, and their solubility was determined as mentioned above:

| Fatty acid poly-hydroxy-amide | Nonionic surfactant | Anionic surfactant | Solvent | Solu-bility |
|---|---|---|---|---|
| GA1 90% | | | 10% PG | 1% |
| GA1 80% | | | 20% PEG400 | 3% |
| GA1 70% | 30% CA050 | | | 19% |
| GA1 70% | 30% LA050 | | | 16% |
| GA1 76.5% | | 15% LAS | 8.5% PG | 13% |
| GA1 63% | | 30% Arkopon T | 7% PG | 31% |
| GA1 65% | 20% CA050 | 15% LAS | | 60% |
| GA1 63% | 27% CA030 | 10% Tensopol USP 94 | | 47% |
| GA1 63% | 27% PA100 | 10% Tensopol USP 94 | | 11% |
| GA1 63% | 27% OA050 | 10% Tensopol USP 94 | | 39% |
| GA1 64% | 16% CA050 | 20% Rewopol SBF 12 | | 43% |
| GA1 64% | 16% CA050 | 20% Hostapur SAS 93 | | 54% |
| GA1 64% | 16% CA050 | 20% Tensopol USP 94 | | 69% |
| GA1 48% | 12% CA050 | 40% Tensopol USP 94 | | 99% |

-continued

| Fatty acid poly-hydroxy-amide | Nonionic surfactant | Anionic surfactant | Solvent | Solu-bility |
|---|---|---|---|---|
| GA1 48% | 32% CA050 | 20% Tensopol USP 94 | | 99% |
| GA2 100% | | | | 0% |
| GA2 49% | 21% LA050 | 30% Tensopol USP 94 | | 42% |
| GA2 49% | 10.5% CA050 | | 10.5% PEG4000 | 49% |
| GA2 28% | 12% CA050 | 60% Tensopol USP 94 | | 99% |
| GA2 35% | 15% C 050 | 50% Tensopol USP 94 | | 85% |

The surfactants used are of the following constitution:

| | |
|---|---|
| PG | Propylene glycol |
| PEG | Polyethylene glycol |
| GA1 | $C_{12}/C_{14}$-fatty acid N-methylglucamide |
| GA2 | $C_{16}/C_{18}$-Fatty acid N-methylglucamide |
| CA030 | Coconut fatty acid amide + 4 EO |
| CA050 | Coconut fatty acid amide + 6 EO |
| LA050 | Linear C12/l4-fatty alcohol + 5 EO |
| OA050 | Oleylamide + 6 EO |
| PA100 | Palm fatty acid amide + 11 EO |
| ® Rewopol SBF 12 | Sulfosuccinate |
| ® Hostapur SAS93 | sec-Alkanesulfonate |
| ® Hostapon SCID | Coconut fatty acid isethionate |
| ® Arkopon T | Oleic acid tauride |
| ® Tensopol USP 94 | $C_{12}/C_{16}$-fatty alcohol sulfate. |

What is claimed is:

1. A solid surfactant kneaded, intimate mixture exhibiting an improved rate of dissolution in water, said mixture comprising fatty acid-N-alkyl-polyhydroxy alkyl amide of the formula (1)

$$RCONR^1Z \quad (1)$$

in which R is $C_7$–$C_{31}$-alkyl or $C_7$–$C_{31}$-alkenyl, Z is a polyhydroxyhydrocarbon group having at least two hydroxyl groups, which may also be alkoxylated, and $R^1$ is $C_1$–$C_8$-alkyl or a group of the formula —$(CH_2)_xNR^2R^3$ or $R^4O(CH_2)_n$—, $R^2$ and $R^3$ are $C_1$–$C_4$-alkyl or $C_2$–$C_4$-hydroxyalkyl, $R^4$ is $C_1$–$C_4$-alkyl and x is a number from 1 to 10 and n is a number from 2 to 4, and at least one surfactant selected from the group consisting of other nonionic surfactants and/or one or more anionic surfactants, said intimate mixture is obtained by heating said fatty acid N-alkyl-polyhydroxyalkylamide and said at least one surfactant to a temperature of from 40° to 130° C. to form a heated mixture, and kneading said heated mixture to form an intimate mixture.

2. The solid surfactant mixture as claimed in claim 1 which comprises fatty acid polyhydroxyamides of the formula I and other nonionic surfactants in a ratio by weight of from 90:10 to 10:90.

3. The solid surfactant mixture as claimed in claim 1 which comprises fatty acid polyhydroxyamides of the formula I and anionic surfactants in a ratio by weight of from 99:1 to 1:99.

4. The solid surfactant mixture as claimed in claim 1 which comprises as fatty acid polyhydroxyamides of the formula I $C_8$–$C_{22}$-acyl-N-methyl-glucamides.

5. The solid surfactant mixture as claimed in claim 1 wherein said nonionic surfactants are selected from (a) fatty acid amide of the formula $R—CON(R^1)_2$ where R is $C_{7-21}$ alkyl or alkenyl and $R^1$ is selected from hydrogen, $C_1$–$C_4$-alkyl, $C_1$–$C_4$-hydroxyalkyl and —$(C_2H_4O)_xH$ where x varies from 1 to 15 and (b) fatty alcohol ethoxylates.

6. The solid surfactant mixture as claimed in claim 1 which comprises as anionic surfactants alkyl ether sulfonates, alkyl sulfates, alkyl ether sulfates, alkylbenzenesulfonates, sec. alkanesulfonates and/or soaps.

7. A solid surfactant kneaded, intimate mixture comprising a $C_8$–$C_{22}$-acyl-N-methylglucamide, a fatty acid amide of the formula (1)

$$R—CON(R^1)_2 \quad (1)$$

where R is $C_{7-21}$ alkyl or alkenyl and $R^1$ is selected from hydrogen, $C_1$–$C_4$-alkyl, $C_{1-C4}$-hydroxyalkyl and —$(C_2H_4O)_xH$ where x varies from 1 to 15 and an alkyl benzenesulfonate and/or alkyl ether sulfate, said mixture is obtained by heating said $C_8$–$C_{22}$-acyl-N-methylglucamide, fatty acid amide (1) and alkyl benzenesulfonate and/or alkyl ether sulfate to a temperature of from 40° to 130° C. to form a heated mixture, and kneading said heated mixture to form an intimate mixture.

8. The solid surfactant mixture as claimed in claim 1 which is present in the form of granules.

9. A solid surfactant kneaded, intimate mixture exhibiting an improved rate of dissolution in water, said mixture comprising fatty acid —N-alkyl-polyhydroxy alkyl amide of the formula (1)

$$RCONR^1Z \quad (1)$$

in which R is $C_7$–$C_{31}$-alkyl or $C_7$–$C_{31}$-alkenyl, Z is a polyhydroxyhydrocarbon group having at least two hydroxyl groups, which may also be alkoxylated, and $R^1$ is selected from a group of the formula —$(CH_2)_xNR^2R^3$ or $R^4O(CH_2)_n$—, $R^2$ and $R^3$ are $C_1$–$C_4$-alkyl or $C_2$–$C_4$-hydroxyalkyl, $R^4$ is $C_1$–$C_4$-alkyl and x is a number from 1 to 10 and n is a number from 2 to 4, and at least one other surfactant selected from the group consisting of nonionic surfactants and anionic surfactants, said intimate mixture is obtained by heating said fatty acid N-alkyl-polyhydroxyalkylamide and said at least one other surfactant to a temperature of from 40° to 130° C. to form a heated mixture, kneading said heated mixture to form the intimate mixture.

* * * * *